United States Patent [19]

Hackman

[11] 4,037,539

[45] July 26, 1977

[54] SPIRAL CHANNEL BLAST-FRAGMENT WARHEAD

[75] Inventor: Emory E. Hackman, Arlington, Va.

[73] Assignee: The United States of America as represented by the Secretary of the Navy, Washington, D.C.

[21] Appl. No.: 168,509

[22] Filed: July 20, 1971

[51] Int. Cl.[2] ..... F42B 13/48

[52] U.S. Cl. ..... 102/67

[58] Field of Search ..... 102/67

[56] References Cited

U.S. PATENT DOCUMENTS

| | | | |
|---|---|---|---|
| 3,435,762 | 4/1969 | Friedman et al. | 102/67 |
| 3,613,586 | 10/1971 | Talley | 102/67 |

*Primary Examiner*—Verlin R. Pendegrass

*Attorney, Agent, or Firm*—R. Sciascia; R. Beers; S. Sheinbein

[57] ABSTRACT

A cylindrical warhead having spiralling channels disposed along the periphery thereof. A center portion of the cylinder contains an explosive and axially located detonators.

9 Claims, 3 Drawing Figures

INVENTOR.
EMORY E. HACKMAN

SPIRAL CHANNEL BLAST-FRAGMENT WARHEAD

BACKGROUND OF THE INVENTION

1. Field of the Invention

The present invention relates generally to warheads, and more particularly to a cylindrical spiral channel blast-fragment warhead.

2. Description of the Prior Art

Standard warheads normally produce a fragment beam of relatively low concentration and velocity. It is not unusual for a warhead to produce a wide fragmentation pattern with an uneven distribution of fragments therein. The sections with few or no fragments therein may be due to the lack of symmetry about 360° with respect to the warhead centerline. It may be due to the breakup of fragments, which is too great or uneven as the fragments move away from the centerline upon the explosion of the warhead device.

SUMMARY OF THE INVENTION

The purpose of the present invention is to provide a warhead which produces a 360° beam of warhead fragments which is narrower, more even and symmetrical, and of higher velocity, than the fragment beam of a conventional warhead.

OBJECTS OF THE INVENTION

An object of the present invention is to increase the damage distance of warheads.

Another object is to produce a substantially uniform fragmentation pattern about an entire 360° from the warhead centerline.

A further object of the invention is to provide a warhead in which the warhead casing fragments can be focused into a narrower beam at greater distances at higher velocities than is possible with conventional warheads.

Other objects, advantages, and novel features of the present invention will become apparent from the following detailed description of the invention when considered in conjunction with the accompanying drawings.

DESCRIPTION OF THE PREFERRED EMBODIMENT

Figure 1:
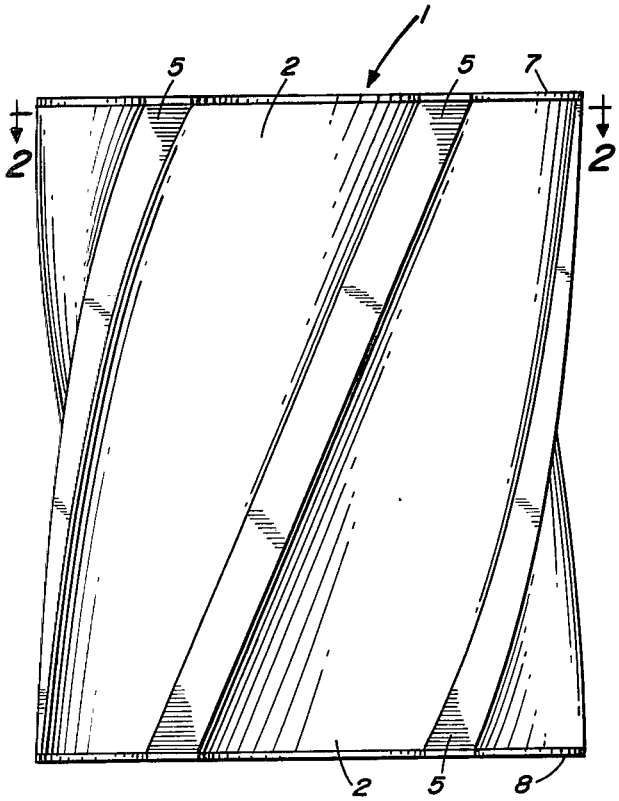
FIG. 1 is a side view of a spiral channel blast-fragment warhead constructed in accordance with the present invention.

FIG. 1, which illustrates a preferred embodiment of the invention, shows a warhead 1. Cylindrical warhead casing 5 has spiralling grooves or channels 2 thereon. Coverplates 7 and 8 are disposed at the top and bottom respectively of the cylindrical warhead casing 5.

Figure 2:
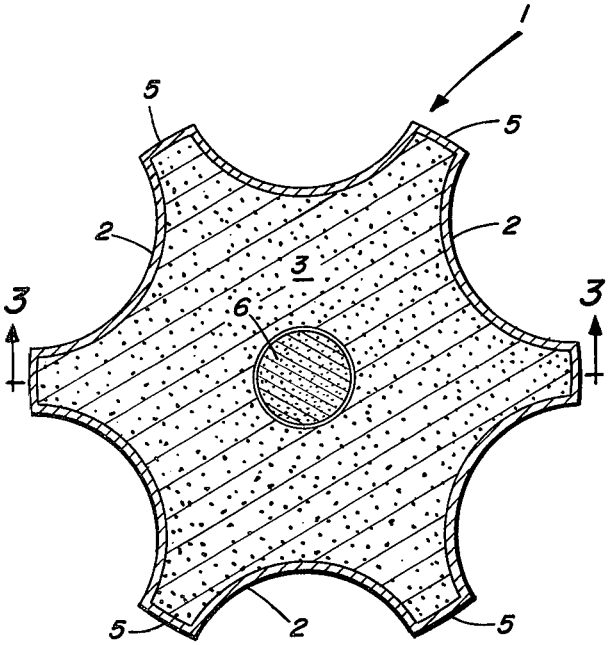
FIG. 2 is a transverse cross-sectional view of the spiral channel blast-fragment warhead taken along line 2—2 of FIG. 1.

The transverse cross-sectional view of FIG. 2 shows casing 5 which is, in the preferred embodiment, 12⅛ inches in outside diameter. The metal of casing 5, in the preferred embodiment, is 3/16inches thick. Spiral grooves 2 are formed of 120° segments of 6 inch outside diameter pipe. Six of the grooves or channels 2 are disposed about the periphery of casing 5 in the preferred embodiment. Two inch diameter detonators 6 are disposed centrally of the warhead casing 5 and explosive material 3.

Figure 3:
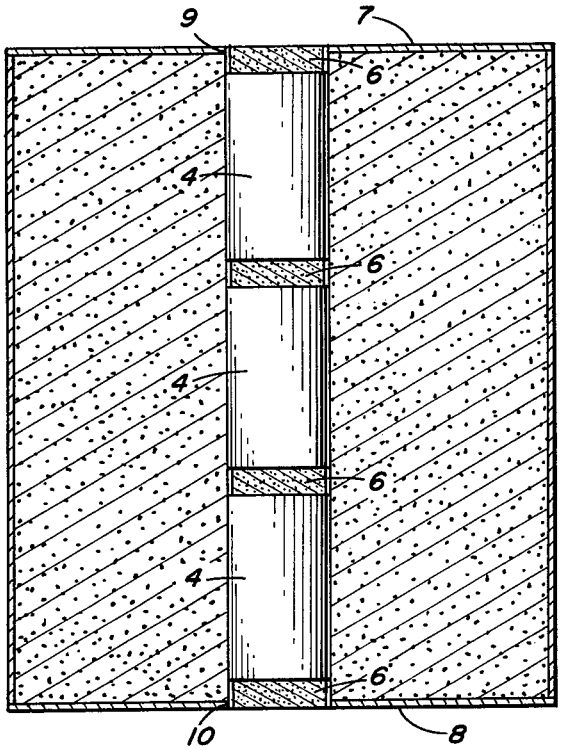
FIG. 3 is a cross-sectional view of the warhead taken along line 3—3 which is cut at the pitch of the spiral as seen in FIG. 2 to show the arrangement of detonators.

The cross-sectional view of FIG. 3 shows ¼ inch thick detonators 6 disposed 4½ inches apart by spacers 4. Coverplates 7 and 8 have openings 9 and 10 respectively for access to detonators 6.

Specifications of the preferred embodiment as follows:

Wt. of metal (mild steel) in the 6 cylindrical channels 29.2 lbs.

Wt. of circumferential metal strip between channels 6.7 lbs.

Total wt. of "active" metal 36.0 lbs.

Wt. of end plates, ⅛ inch thick 4.0 lbs.

Explosive wt., at 0.06 lbs/in 41.2 lbs.

Charge/mass of sides 1.14 lbs.

Total warhead wt.

81 lbs.

Each of the channels 2 forms a concentrated, line-like front of fragments as the fragments move outwardly upon detonation. Due to the channel configuration, the parts of the channel nearest the outer part of the casing are deflected inwardly towards the fragments of the center portion of the channels as the fragments move outwardly from the warhead. The channel configuration causes a fragmentation pattern in which the fragments emanate in a radial direction directly out from the spiral channels in a concentrated manner. The spiralling of the channels helps to distribute the fragmentation pattern of the channels evenly about 360°.

In the spiral channel blast-fragment warhead of the preferred embodiment, the detonators 6 are spaced about 4½ inches apart in order to reduce the detonation wave grazing angles on impingement with the warhead casing, and hence increase velocity and reduce beam spread, that is, to aid in focusing the fragments into a narrow beam circumferential to the device. Approximately 70% of the warhead casing can be focused into a 1 ft. wide beam at a 45 ft. radius. Therefore, $$\frac{36 \text{ lbs.} \times 7000 \text{ grains/lb.}}{2\pi \times 45 \text{ ft.} \times 1 \text{ ft.}} = 892 \text{ grains/ft.}^2.$$

An 892 grains/ft. sq. X 70% = 625 grains/ft. sq.. Hence, the spiral channel blast-fragment warhead as presented herein, at a striking velocity greater than or equal to 8,600 ft./sec., will produce a mass density on target approximately equal to 625 grains/ft. sq. at a 45 ft. radius.

The device of the preferred embodiment disclosed herein has a catastrophic kill damage distance of at least 45 ft. against aircraft. Comparatively, other warheads of this size have achieved a capability of only about 26 ft.

Obviously many modifications and variations of the present invention are possible in the light of the above teachings. It is therefore to be understood that, within the scope of the appended claims, the invention may be practiced otherwise than as specifically described. For example, the channel radius and degrees of sectors can be changed. The wall thickness and cross section can be varied. The number and placement of detonators, manner of detonation, and time sequencing of detonation can be varied. The number of channels and degrees of twist can be changed. Different casing materials and various acceptable explosives may be used. The overall dimensions of the preferred embodiment may be changed. And, combinations of the above suggested changes can be made to alter the blast characteristics to produce various fragmentation patterns.

What is claimed is:

1. A warhead comprising:

a solid, one-piece, substantially cylindrical casing;

coverplates on the ends of of said casing;

an explosive material substantially filling said casing and extending to the inner periphery of said casing;

plural detonators symmetrically disposed along the longitudinal axis of said casing within said explosive material; and spiral channel means having a concave circular-arc-shaped cross-section formed in said casing for producing a particular fragmentation pattern.

2. The device of claim 1 wherein said casing is of uniform thickness.

3. The device of claim 1 wherein said channel means is, in cross-section, formed of substantially a 120° arc.

4. The device of claim 1 wherein said channel means is, in cross-section, an arc formed within a range of approximately 90°–180 degrees.

5. The device of claim 1 wherein channel means comprises a plurality of channels on said casing.

6. The device of claim 1 wherein there said channel means comprises six channels.

7. The device of claim 1 wherein said channel means is of uniform depth throughout its length.

8. The device of claim 1 wherein said casing is symmetrical about a plane containing the longitudinal axis of the warhead.

9. The device of claim 1 wherein a spiral channel of said spiral channel means extends around less than a full revolution of said casing.

* * * * *